United States Patent [19]

Pevzner et al.

[11] 4,184,972

[45] Jan. 22, 1980

[54] MAGNETODIELECTRIC MATERIAL

[76] Inventors: Lev V. Pevzner, ulitsa Chkalova 52, kv. 54, Moscow; Alexandr N. Ustkachkintsev, ulitsa Kozlova 11, kv. 29, Orekhovo-Zuevo Moskovskoi oblasti; Boris V. Yakobson, ulitsa Pravdy 11, kv. 36, Orekhovo-Zuevo Moskovskoi oblasti; Andrei V. Timofeev, ulitsa Dzerzhinskogo 65, Orekhovo-Zuevo Moskovskoi oblasti; Anna A. Furman, ulitsa Gagarina 4, kv. 23, Orekhovo-Zuevo Moskovskoi oblasti; Sergei E. Vaskanov, ulitsa G. Kochara 9, kv. 31, Erevan; Vadim V. Alexeevsky, ulitsa Kalinina 2, kv. 14, Erevan; Jury S. Chatinian, ulitsa Tamanina 1, kv. 6, Erevan; Felix K. Makarov, ulitsa P. Osipenko 10, kv. 13, Vladimir; Vladimir I. Radin, ulitsa Stroitelei 6, korpus 4, kv. 16, Moscow; Viktor M. Petrov, ulitsa Fligina 10, Vladimir, all of U.S.S.R.

[21] Appl. No.: 929,360

[22] Filed: Jul. 31, 1978

[51] Int. Cl.[2] ..... H01F 1/00; H01F 1/37

[52] U.S. Cl. ..... 252/62.54

[58] Field of Search ..... 252/62.54, 62.53

[56] References Cited

U.S. PATENT DOCUMENTS

| | | | |
|---|---|---|---|
| 1,682,364 | 8/1928 | Ballantine et al. | 252/62.54 X |
| 3,228,881 | 1/1966 | Thomas | 252/62.54 |
| 3,360,475 | 12/1967 | Rossez | 252/62.52 |
| 3,625,760 | 12/1971 | Slovinsky | 252/62.54 X |
| 3,740,266 | 6/1973 | Akash et al. | 252/62.54 X |
| 4,040,971 | 8/1977 | Simmonds | 252/62.54 |

*Primary Examiner*—F. C. Edmundson

*Attorney, Agent, or Firm*—Lackenbach, Lilling & Siegel

[57] ABSTRACT

The invention contemplates an iron-based magnetodielectric material comprising a thermoreactive binder in the form of modified and non-modified phenol formaldehyde resins, and a filler in the form of a fibrous filler preliminarily impregnated with said resins, the components being used in the following quantities, in % by weight:

thermoreactive binder—8 to 25
impregnated fibrous filler—5 to 20
lubricant—0.5 to 1.5
iron—the balance.

8 Claims, No Drawings

MAGNETODIELECTRIC MATERIAL

The invention relates to the manufacture of magnetodielectric materials to be used in the electrical engineering, electronics, radio engineering and other industries.

Known in the art is an iron based magnetodielectric material comprising a thermoreactive resin which is represented by a product of compounding furane and epoxy resins, the material having the following composition:

furane-epoxy resin—100 w.p.
iron powder—250 w.p.
hardeners: hexamethylenediamine, polyethylenepolyamine—15 w.p.
glass fiber additive—1-1.5 w.p.

Known in the art is another iron-based magnetodielectric material comprising a thermoreactive resin and a filler, the thermoreactive resin comprising an epoxy-novolac block-copolymer, the material having the following composition:

epoxy-novolac block copolymer—30-35 w.p.
formamine—3-4 w.p.
phthalic anhydride—2-3 w.p.
filler—5-6 w.p.
iron—the balance.

The known magnetodielectric materials, however exhibit insufficiently high physical and mechanical properties and inadequate resistance against vibrations, because of insufficiently high elasticity of the binder.

It is an object of the invention to provide a magnetodielectric material which exhibits high physical and mechanical properties and dielectric characteristics, as well as enhanced performance characteristics.

Another object of the invention is to provide a magnetodielectric material having desired magnetic permittivity.

According to the invention these objects are accomplished with an iron-based magnetodielectric material comprising a thermoreactive binder containing a fibrous filler preliminarily impregnated with the thermoreactive resin used or a resin of the same type, the components being used in the following quantities, in % by weight:

thermoreactive binder—8 to 25
impregnated filler—5 to 20
lubricant—0.5 to 1.5
iron—the balance.

Modifiers for phenol formaldehyde resins preferably comprise polyolefins and their derivatives, polyvinylacetals and colophony.

Owing to varying the composition and binder and preliminary impregnation of the filler, the magnetodielectric material exhibits substantially improved physical and mechanical properties, magnetic permittivity and performance characteristics.

Examples of preparing the magnetodielectric material will be described below.

It should be noted that the thermoreactive binder may comprise modified and non-modified phenol formaldehyde resins of novolac and resol type. In case novolac phenol formaldehyde resins are used, a hardener is employed, e.g. hexamethylenetetramine. Modifiers comprise polyolefines and their derivatives, polyvinylacetals and colophony, the amount of modifiers being from 10 to 30% by weight of the resin. The filler may comprise asbestos fiber, glass fiber, synthetic fibers, such as polyethyleneterephthalate fiber. The fibrous filler is introduced into the composition after preliminary impregnation of the former with 20-60% solution of the binder used or a binder of the same type.

The lubricant may comprise fatty acids and their salts, such as oleic and stearic acids, calcium stearate.

The magnetodielectric material is prepared by a conventional method which is used for the manufacture of phenol plastics under the following production conditions.

Technique 1 (using dry resin)

A thermoreactive binder, with the addition of lubricants, is compounded with iron powder with mechanical dispersion of the products. The composition is homogenized in rolls, reduced to powder and subsequently the resultant powder and fibrous filler preliminarily impregnated with the same binder are fed to a mixer. Then articles are manufactured from the material by compression molding. This technique is used when a glass fiber filler treated with phenol formaldehyde resin is employed.

Technique 2 (using emulsified resin)

A mixer is charged with a thermoreactive binder in the form of 40-90% alcoholic solution, and iron powder. After compounding the iron powder and the binder, fibrous filler impregnated with the same binder is charged into the mixer. The composition is homogenized in water-cooled non-friction rolls and dried at 60°-90° C. to a required fluidity.

Better understanding of the invention may be had from a consideration of the following specific embodiments illustrating the preparation of magnetodielectric materials.

EXAMPLE 1

15.5 wt.% of novolac phenol formaldehyde resin, 3 wt.% of hexamethylenetetramine, 0.7 w.p. of calcium stearate and 66.8 wt.% of iron powder were charged into a mixer. The components were stirred for 60 minutes. The resultant mixture was homogenized in friction rolls at working roll temperatures from 70° to 100° C. and idle roll temperatures from 105° to 140° C. for 6-10 minutes. The rolled mass was cooled down and comminuted. The resultant composition was mixed with 14 wt.% of chopped glass fiber which was preliminarily impregnated with resol phenol formaldehyde resin. The magnetodielectric material was processed into articles by using conventional methods for processing phenol plastics.

EXAMPLE 2

8 wt.% of resol phenol formaldehyde resin, 0.5 w.p. of calcium stearate, 71.5 wt.% of iron powder were charged into a mixer and stirrer for 40-50 minutes. The resultant mixture was rolled and comminuted. The comminuted composition was mixed with 20 wt.% of chopped glass fiber which was preliminarily impregnated with phenol formaldehyde resin.

EXAMPLE 3

25 wt.% of resol phenol formaldehyde resin modified with chlorosulphonated polyethylene, 1 wt.% of calcium stearate, 69 wt.% of iron powder were charged into a mixer and stirred until a homogeneous mixture was obtained. The resultant mixture was rolled, comminuted and then mixed with 5 wt.% of glass fiber impregnated with resol phenol formaldehyde resin.

EXAMPLE 4

9 wt.% of emulsified phenol formaldehyde resin modified with polyvinylbutyral, 1.5 wt.% of oleic acid, 1.5 wt.% of hexamethylenetetramine were charged into a mixer and stirred for 20–30 minutes. Then 79 wt.% of iron powder were introduced into the mixer and the stirring was continued for another 30–40 minutes. The resultant mixture was rolled at room temperature without friction in water-cooled rolls, then dried and comminuted. The resultant composition was mixed with 9 wt.% of glass fiber preliminarily impregnated with resol phenol formaldehyde resin.

EXAMPLE 5

10 wt.% of emulsified phenol formaldehyde resin modified with colophony, 0.5 wt.% of oleic acid, 10 wt.% of asbestos fiber were charged into a mixer, and the treatment continued until the fibre got completely impregnated. Then another 10 wt.% of the same resin and 69.5 wt.% of iron powder were introduced into the mixer, and the stirring was continued for 40–50 minutes.

The mixture was homogenized in rolls without friction, with subsequent drying and comminution.

EXAMPLE 6

8 wt.% of emulsified phenol formaldehyde resin, 71.3 wt.% of iron powder were charged into a mixer, stirred for 30 minutes, discharged, dried and comminuted.

8 wt.% of the same resin, 0.7 wt.% of stearic acid, 12 wt.% of polyethyleneterephthalate fiber were charged into a mixer to impregnate the fibre. Then the resin impregnated and dried iron powder was introduced into the mixer, and all the components were stirred for 20–30 minutes. The resultant mixture was subsequently rolled and dried.

Magnetodielectric molding materials obtained according to the invention are to be used in the manufacture of parts of electrical machines, in particular, magnetic slot wedges of electrical machines. The magnetodielectric materials according to the invention have the following properties:

density, g/cm$^3$—3.5–4.5
impact viscosity, kgf.cm/cm$^2$—10–30
ultimate bending strength, kgf/cm$^2$—600–1000
compression strength, kgf/cm$^2$—1300–2000
Martens thermal stability, °C.—120–200
Brinell hardness, kgf/cm$^2$—4000–7500
permittivity at H=3000 A/cm—3.0–8.0
shrinkage, %—0.2–0.5
operating time under extreme condition, h—50.000–60.000

After heating the magnetodielectric material at 200° C. during 14 days its properties did not change.

The magnetodielectric material according to the invention used for the manufacture of slot wedges of electrical machines improves their efficiency by 1–2%, lowers overheating, reduces vibroacoustic noises and improves the reliability of electrical machines in operation.

We claim:

1. A homogeneous iron-based magnetodielectric material comprising a thermoreactive binder in the form of modified and non-modified phenol formaldehyde resins, and a filler in the form of a fibrous filler preliminarily impregnated with said resins, the components being used in the following quantities, in % by weight:

thermoreactive binder—8 to 25
impregnated fibrous filler—5 to 20
lubricant—0.5 to 1.5
iron—the balance.

2. A magnetodielectric material according to claim 1, wherein the modifier for phenol formaldehyde resins comprises polyolefins and their derivatives.

3. A magnetodielectric material according to claim 1, wherein the modifier for phenol formaldehyde resins comprises polyvinylacetal.

4. A magnetodielectric material according to claim 1, wherein the modifier for phenol formaldehyde resins comprises colophony.

5. A magnetodielectric material according to claim 1, wherein the amount of modifiers vary from 10–30% by weight of the resin.

6. A magnetodielectric material according to claim 1, wherein the lubricant is selected form the group consisting of fatty acids and their salts.

7. A magnetodielectric material according to claim 6, wherein the lubricant is selected from the group consisting of oleic acid, stearic acid and calcium stearate.

8. A magnetodielectric material according to claim 1, wherein the filler is selected from the group consisting of asbestos, glass, and synthetic fibers.

* * * * *